US005390851A

United States Patent [19]

Long et al.

[11] Patent Number: 5,390,851

[45] Date of Patent: Feb. 21, 1995

[54] SOLENOID OPERATED UNIT FUEL INJECTOR WITH SUPPLY LINE BACKFLOW PRESSURE RELIEF VALVE

[75] Inventors: Martin W. Long; George L. Muntean; Paul D. Free, all of Columbus, Ind.

[73] Assignee: Cummins Engine Company, Inc., Columbus, Ind.

[21] Appl. No.: 183,851

[22] Filed: Jan. 21, 1994

[51] Int. Cl.[6] ..... F02M 47/02

[52] U.S. Cl. ..... 239/88; 239/126

[58] Field of Search ..... 239/88–94, 239/96, 124, 126, 127, 585.1

[56] References Cited

U.S. PATENT DOCUMENTS

| | | | |
|---|---|---|---|
| 233,432 | 10/1980 | Pitchford | 417/503 |
| 2,551,053 | 5/1951 | Rogers | 239/88 X |
| 2,590,575 | 3/1952 | Rogers | 239/88 X |
| 4,095,617 | 6/1978 | Hodgson | 137/596.13 |
| 4,531,672 | 7/1985 | Smith | 239/89 |
| 4,565,320 | 1/1986 | Taniguchi et al. | 239/88 X |
| 5,014,918 | 5/1991 | Halvorsen | 239/410 |

*Primary Examiner*—Andres Kashnikow
*Assistant Examiner*—Lesley D. Morris
*Attorney, Agent, or Firm*—Sixbey, Friedman, Leedom & Ferguson

[57] ABSTRACT

In accordance with a preferred embodiment of the invention, a solenoid operated unit fuel injector, for internal combustion engines of the type which are capable of having distinct timing, metering and injection periods, and in which the same supply line serves for the delivery of fuel to both a timing chamber and a metering chamber, is improved by providing a drilling in the injector barrel which leads directly from the timing fluid flow portion of the fuel supply circuit to an injector fuel drain path, and mounting a C-shaped spring valve on the injector body for controlling dumping of fuel through the drilling at a location above that of the timing and metering spill ports.

15 Claims, 5 Drawing Sheets

SOLENOID OPERATED UNIT FUEL INJECTOR WITH SUPPLY LINE BACKFLOW PRESSURE RELIEF VALVE

BACKGROUND OF THE INVENTION

1. Field of the Invention

The present invention relates to solenoid operated unit fuel injectors for internal combustion engines. In particular, to such fuel injectors which are capable of having distinct timing, metering and injection periods, and in which the same supply line serves for the delivery of fuel to both a timing chamber and a metering chamber.

2. Description of Related Art

Solenoid operated fuel injectors, of the type to which the present invention is directed, have been used for some time, and an example of such an injector can be found in commonly-owned U.S. Pat. No. 4,531,672 to Smith. In this type of injection, a timing chamber is defined between a pair of plungers that are reciprocably displaceable within the bore of the body of the injector and a metering chamber is formed in the bore below the lower of the two plungers. A supply rail in the engine delivers a low pressure supply of fuel to the injector body. To control this supply of fuel, a solenoid valve is disposed in the flow path between the fuel supply rail and the injector bore and the plungers block and unblock respective ports leading from injector body fuel supply circuit into the timing and metering chambers.

During the operation of such an injector, the port to the timing chamber is opened during retraction of the plungers to allow fuel to enter the timing chamber. During the injector downstroke, the timing port is closed by the upper plunger, and then, the metering port is opened to direct the supply of fuel into the metering chamber. During the entire time, from the start of the timing period through the end of the metering period, the solenoid valve remains open. As a result, during the portion of the downstroke before the timing port is closed, the downward plunger movement produces a high pressure backflow of fuel from the timing chamber, through the solenoid valve to the supply rail. Not only can this high pressure backflow damage O-ring seals within the injector, but it creates pulsations in the fuel supply rail that can result in a phenomenon known as "crosstalk", whereby the pressure wave produced by the backflowing injector causes "bumping" of an inlet check ball valve of other injectors of the engine so as to exert an influence on the quantity of fuel metered in the other injectors.

In an existing injector design, sold by the Cummins Engine Co. under the CELECT trademark, shown in FIGS. 1–3 & 3*a*, improved performance is achieved, and the timing fluid backflow-related problems ameliorated. In this existing fuel injector 1, as shown in FIG. 1, initially, during the retraction stroke, with the solenoid valve 3 closed, the metering plunger 5 and the timing plunger 7 rise together, and fuel under rail pressure is metered into the metering chamber 9. When the proper quantity of fuel has been metered, the solenoid valve 3 is opened, allowing fuel to flow into the timing chamber 11, causing the pressure at the top and bottom of the metering plunger to be equalized, thereby stopping movement of the metering plunger 5 while the timing plunger 7 continues to rise, and the timing chamber 11 to fill, as the retraction stroke is completed. During the downstroke, prior to the time at which injection is to commence, as shown in FIG. 3, the solenoid valve 3 remains open and fuel is forced back out of the timing chamber 11, through the solenoid valve 3 into the supply circuit.

However, unlike the situation in the injector of the Smith patent, a relief valve assembly 15 is provided to vent high pressure spikes from the rail side of the injector 1 to the drain side thereof (FIG. 3A). More specifically, the relief valve assembly 15 comprises a valve member 15*a* which is urged against a relief port 15*b* by a coil spring 15*c* which is disposed in spacer member 17, the upper surface of which forms the bottom wall of the metering chamber 9 and which contains channels through which fuel flows between the fuel inlet port 19 and the metering chamber 9 and from the relief valve 15 to a drain passage 21. When the pressure of the backflowing timing fluid exceeds that of spring 15*c*, the valve member 15*a* unblocks relief port 15*b*, thereby opening a path from the fuel supply circuit to drain passage 21.

Similarly, at the end of the injection phase, when the solenoid 3 is closed, the top edge of the metering plunger 5 passes below at least one timing fluid spill port 23, thereby evacuating the timing chamber 11 via the drain passage 21. Additionally, passages 5*a* in the metering plunger 5 are brought into communication with at least one spill port 25 by which a small quantity of fuel is spilled to the fuel supply circuit. To prevent pressure spikes due to the fuel spilling from the metering chamber 5, valve member 15*a*, again, is forced open to vent the excess fuel pressure from the supply side thereof to the drain passage 21.

On the other hand, while a definite improvement over other prior art injectors, it has been found that the valve assembly 15 does not fully resolve the problems associated with pressure build-ups in the fuel supply circuit, and shot-to-shot fuel volumes can vary by as much as a third during engine idling conditions, thereby adversely impacting on idling emissions from the engine with which the fuel injector is used. These inconsistencies appear to be due to the length and tortuous nature of the path of the supply side fuel routing to the valve assembly, which affects the time it takes for the pressure wave to reach valve member 15*a* and the pressure of the fuel when it does reach valve member 15*a*. However, the space requirements for such a spring-loaded valve assembly 15 and the limited space available for it to be incorporated into the injector, prevent the problems associated with the use of valve assembly 15 from being fully addressed by merely shifting its position to shorten and simplify the flow routing to it. Furthermore, the use of valve assembly 15 is associated with the costs of the high degree of precision machining required to produce it and the flow paths to and from it, as well as that attributable to production and assembly of the three parts thereof (i.e., valve member 15*a*, valve spring 15*c* and the threaded plug 15*d* used to hold them in place).

One-way, spring valves, which permit a fluid to flow therethrough in only a given direction and as a function of the extent to which the pressure of the fluid acting in prescribed flow direction exceeds the force of the spring in a valve closing direction, have also been known for a long time. Such valves in which a band-shape spring serves as the valve spring have been used in numerous types of equipment, from air compressors (U.S. Pat. No. 233,432) to controls for load-moving mechanisms (U.S. Pat. No. 4,095,617). In various different types of fuel injectors such spring valves have been used to control the supply of fuel to a fuel injector nozzle (U.S. Pat. Nos. 2,590,575 and 5,014,918) as well as the releasing of timing fluid from a timing chamber (commonly assigned, co-pending U.S. Pat. application Ser. No. 07/898,818 to Kolarik et. al.). However, because of the construction of the noted CELECT injectors, such a band spring valve cannot merely be substituted for its relief valve assembly 15; furthermore, more than mere adaption of the barrel member for the use of such a valve would be required to overcome the noted shortcomings of the valve assembly 15.

Thus, there still is a need for further improvements to fuel injectors of the type to which this invention is directed, both from the standpoint of reducing supply side pressure effects, and from the standpoint of simplifying the construction and costs of producing such fuel injectors.

SUMMARY OF THE INVENTION

In view of the foregoing, it is an object of the present invention to avoid the creation of pressure waves in the fuel supply of a unit fuel injector of the initially-mentioned type by venting of excessive pressure occurring in the fuel supply circuit of the injector body due to backflow from the timing chamber in a simple and cost effective manner.

In connection with the preceding object, it is a more specific object to utilize a C-ring valve as a pressure responsive means for providing a one-way communication between the fuel supply circuit in the injector and a drain port of the injector body.

A still further object is to enable a pressure relief valve to be utilized in a way which will shorten and simplify the routing to the relief valve so as to cause the relief valve to respond to pressure increases more quickly and consistently.

Yet another object is to reduce the costs associated with manufacture of a unit fuel injector of the initially-mentioned type by reducing the number of parts required and the degree of precision machining thereof as well as offering the ability to reduce the overall size of the fuel injector.

These and other objects are achieved in accordance with a preferred embodiment of the invention by providing a drilling in the injector barrel which leads directly from the fuel supply circuit to injector fuel drain path, and mounting a C-ting valve on the injector barrel for controlling dumping of fuel through the drilling at a location above that of the timing and metering spill ports.

These and further objects, features and advantages of the present invention will become apparent from the following description when taken in connection with the accompanying drawings which, for purposes of illustration only, show a preferred embodiment in accordance with the present invention.

DETAILED DESCRIPTION OF THE PREFERRED EMBODIMENT

Figures 3, 3A:
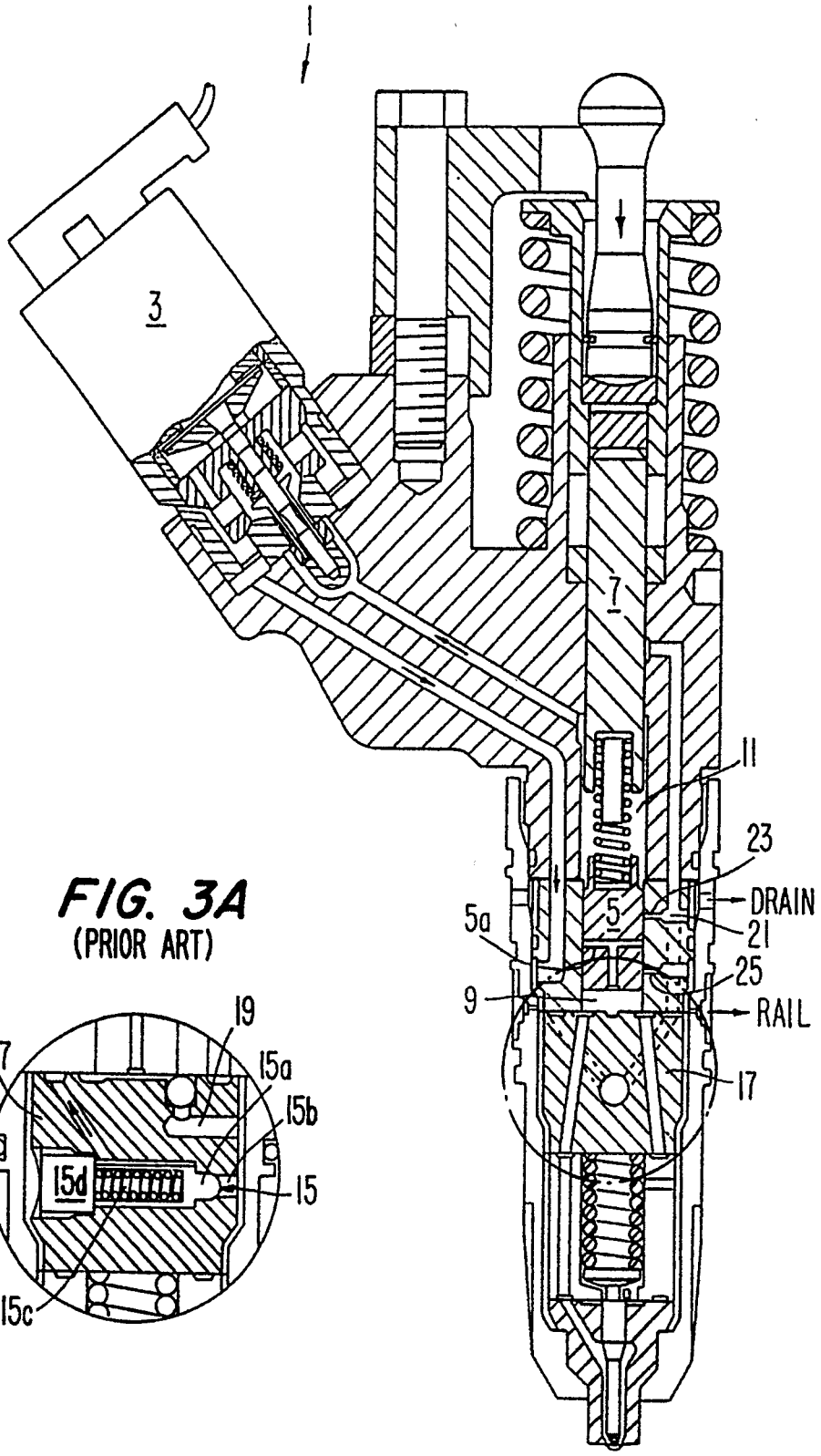
FIG. 3 (PRIOR ART)
FIG. 3A (PRIOR ART)
FIG. 3 is schematic cross-sectional depiction of the FIG. 1 fuel injector during a timing phase.
FIG. 3A is an enlarged showing of detail circle A in FIG. 3.
Figure 4:
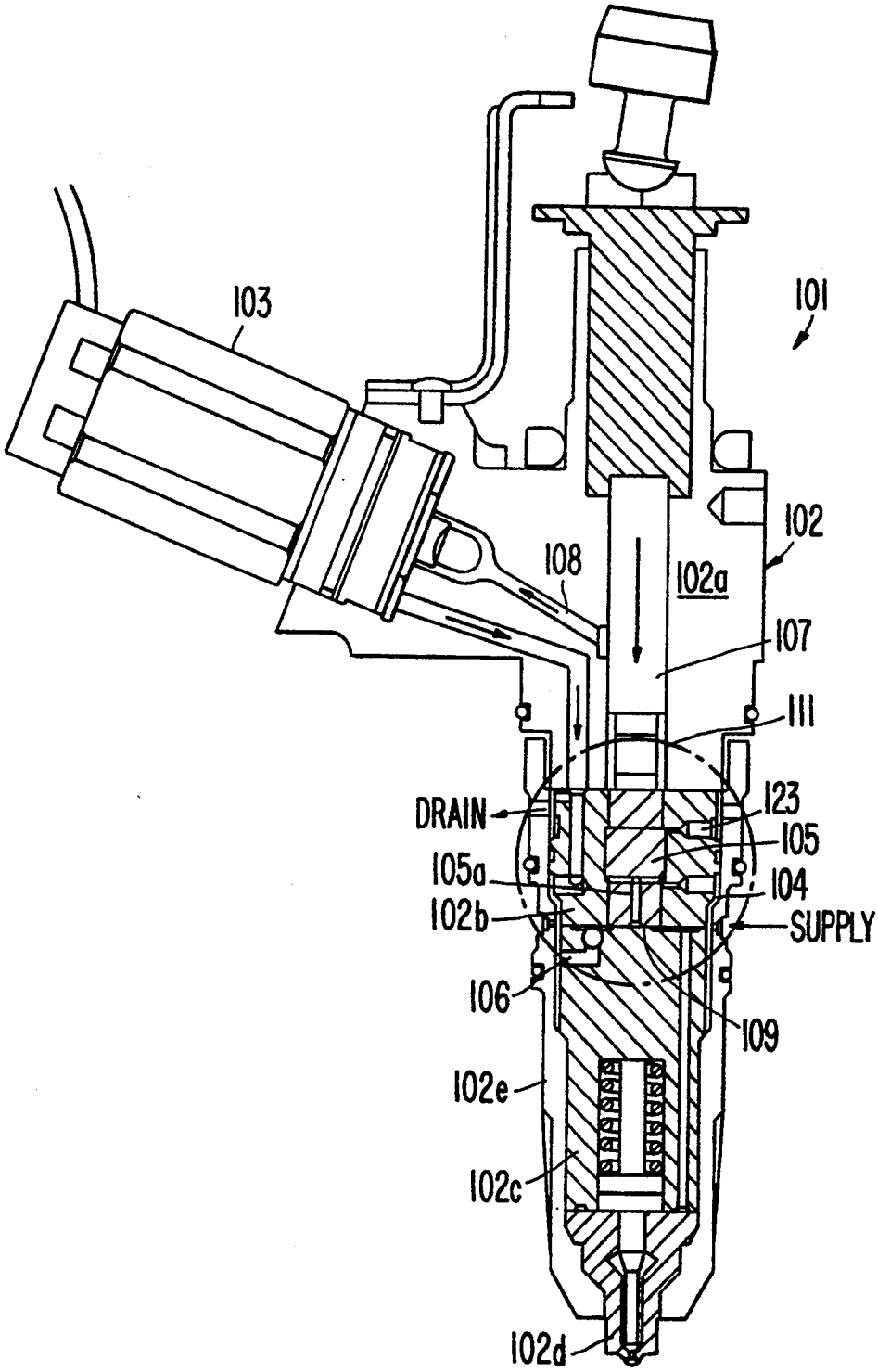
FIG. 4 is a vertical cross section of a fuel injector in accordance with the present invention.
Figure 5:
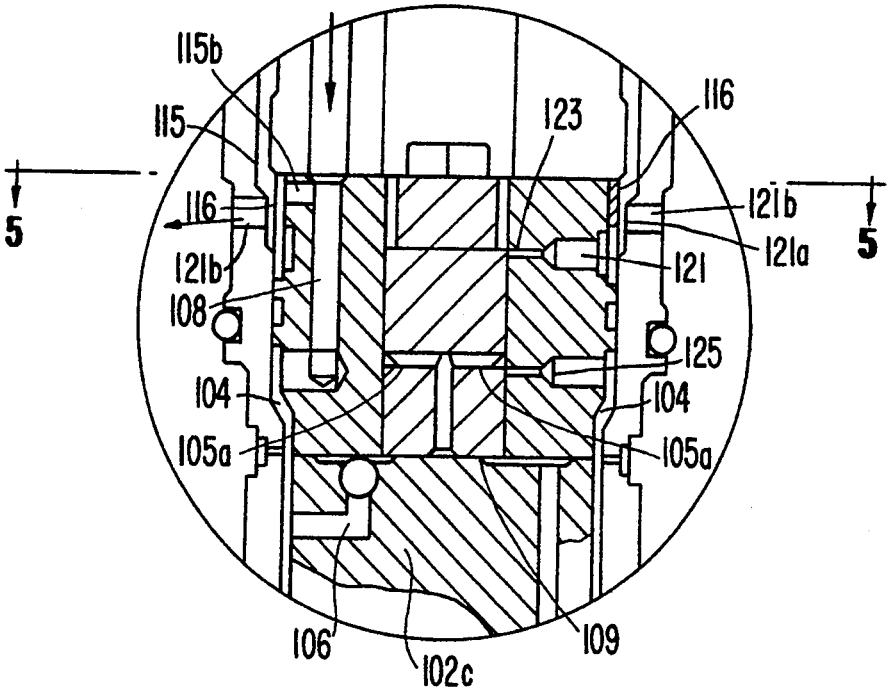
FIG. 5 is an enlarged showing of the encircled detail of FIG. 4.
Figure 6:
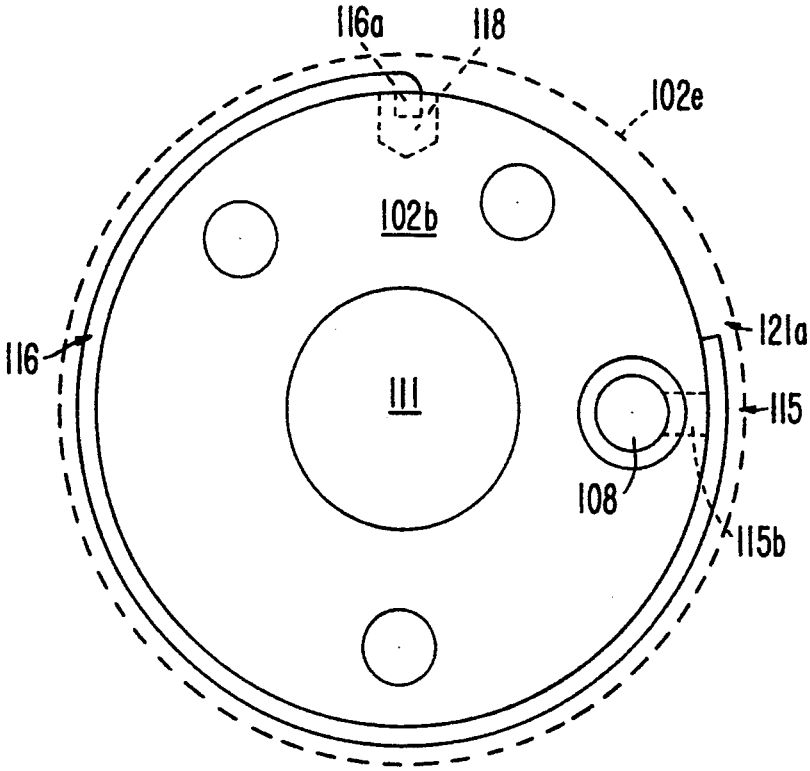
FIG. 6 is an cross-sectional view taken along line 5—5 of FIG. 4 but rotated 180°.

With reference to FIGS. 4–6, a unit fuel injector 101, in accordance with the present invention, will now be described. Furthermore, to facilitate comparison with the above-described CELECT fuel injector of FIGS. 1–3, parts of the injection of FIGS. 4–6 which correspond to parts of the CELECT injector of FIGS. 1–3 (even though not necessarily identical) have been identified by the same reference numerals used in FIGS. 1–3 but increased by a factor of 100 (e.g., part 105 in FIGS. 4–6 corresponds to the metering piston 5 of FIGS. 1–3).

Figure 1:
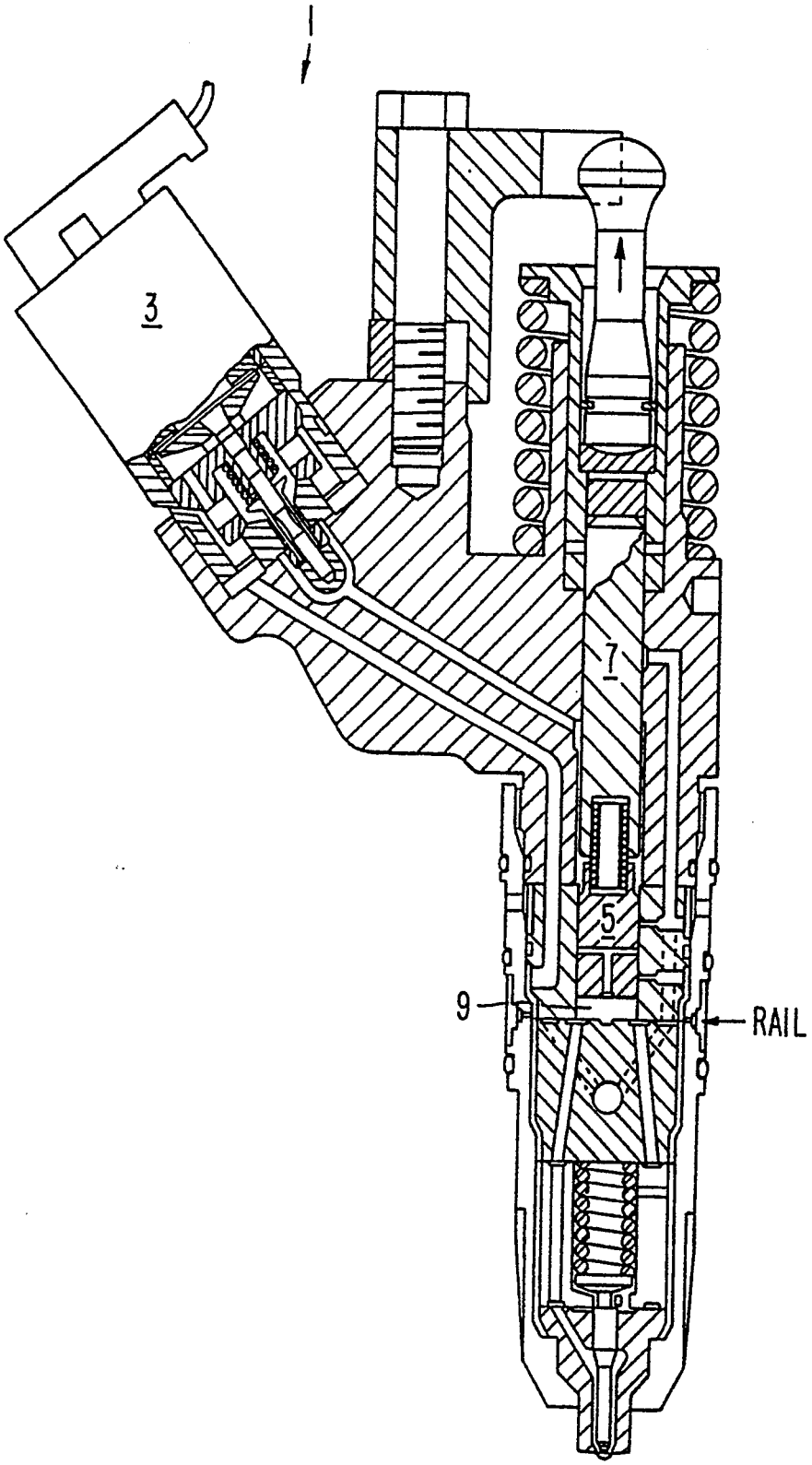
FIG. 1 (PRIOR ART)
FIG. 1 is schematic cross-sectional depiction of an existing fuel injector during a metering phase.
Figure 2:
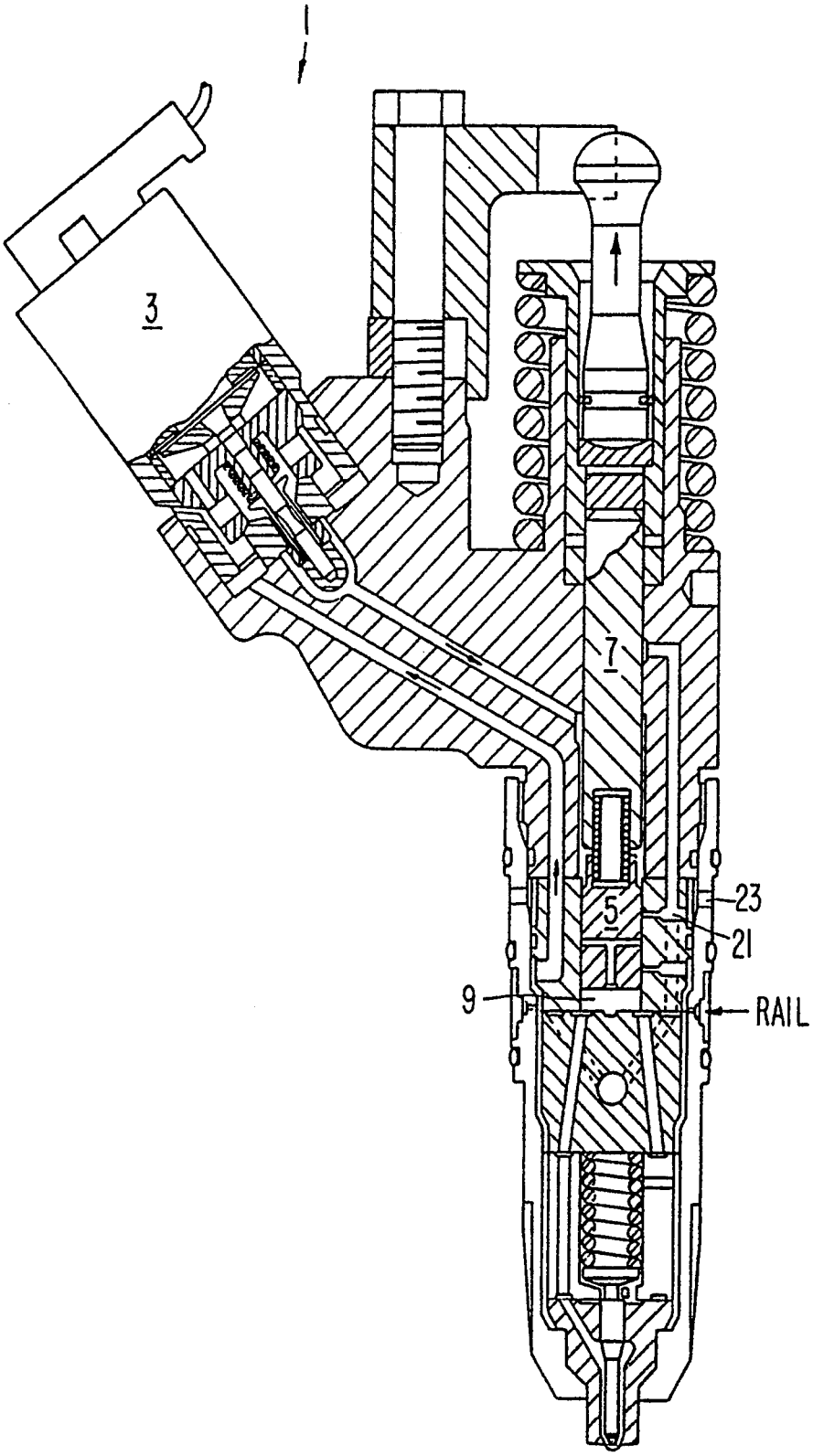
FIG. 2 (PRIOR ART)
FIG. 2 is schematic cross-sectional depiction of the FIG. 1 fuel injector during a timing chamber filling phase.

Like the injector 1 of FIGS. 1–3, injector 101 is capable of having distinct timing, metering and injection periods and comprises an injector body 102, formed of an upper barrel 102*a*, and inner barrel 102*b*, a spring housing 1-2*c*, an injector nozzle 102*d* and an injector retainer 102*e* which receives the inner barrel 102*b*, nozzle valve spring housing 102*c*, and injector nozzle 102*d*, stacked one upon the other, and secures them to the upper barrel 102*a*. The injector body 102 also has an axial bore, the portion of which is located in the upper barrel 102*a* forming a variable volume timing chamber 111 between the timing plunger 107 and the metering plunger 105, and the portion of which is located in the inner barrel forming a variable volume metering chamber 109 between the metering plunger 105 and the top of the nozzle valve spring housing 102*c*.

A supply circuit is provided in the injector body by which fuel from a supply rail of the engine enters a fuel inlet and travels to a fuel annulus 104 formed between the injector retainer 102*e*, and the inner barrel 102*b* and spring housing 102*c*. A first flow path 106 leads from the fuel annulus 104 to the metering chamber and a second flow path 108 leads from the fuel annulus to the timing chamber 111, and a solenoid valve is disposed in this second flow path of the fuel supply circuit for blocking and unblocking flow along second flow path 108 to and from said timing chamber 111. A drain path is also formed in injector barrel 102*b* along which timing fluid, at the end of each injection cycle, is drained from the timing chamber 111 via a timing spill port 123, into a drain passage 121, which includes a drain annulus 121*a* and drain ports 121*b*, into a drain rail of the engine (not shown).

Thus, like the CELECT injector, initially, during the retraction stroke, with the solenoid valve 103 closed, the metering plunger 105 and the timing plunger 107 rise together, and fuel under rail pressure is metered into the metering chamber (shown fully collapsed in FIG. 4). When the proper quantity of fuel has been metered, the solenoid valve 103 is opened, allowing fuel to flow into the timing chamber 111, causing the pressure at the top and bottom of the metering plunger 105 to be equalized, thereby stopping movement of the metering plunger 105 while the timing plunger 107 continues to rise, and the timing chamber 111 to fill, as the retraction stroke is completed. During the downstroke, prior to the time at which injection is to commence, the solenoid valve 103 remains open and fuel is forced back out of the timing chamber 111, through the solenoid valve 103 into the supply circuit.

However, the nature and location of relief valve 115, provided to vent high pressure spikes from the rail side of the injector 101 to the drain side thereof, differs from the relief valve assembly 15 of the CELECT injector of FIGS. 1–3. More specifically, the relief valve assembly 115 comprises a C-shaped band spring valve member 116 which is pretensioned to lie over the periphery of inner barrel 102*b* in sealing engagement therewith so as to close a relief port 115*b* which is disposed in inner barrel member 102*b* running from second flow path 108 to drain annulus 121*a* at a location above drain spill port 123 and fuel spill port 125. Proper positioning of the band spring valve member 116 is obtained by a tab-like radially-directed end part 116*a* being disposed in a hole 118 in the periphery of the inner barrel member 102*b*.

When the pressure of the backflowing timing fluid exceeds that of spring valve member 116, the valve member 116 unblocks relief port 115*b*, thereby opening a path from the second path 108 of the fuel supply circuit to the drain passage 121 at drain annulus 121*a*. Similarly, at the end of the injection phase, when the solenoid 103 is closed, the top edge of the metering plunger 5 passes below at least one timing fluid spill port 123, thereby evacuating the timing chamber 111 via the drain passage 121, and the passages 105*a* in the metering plunger 105 are brought into communication with at least one spill port 125, thereby spilling a small quantity of fuel to the fuel supply circuit, pressure spikes due to the fuel spilling from the metering chamber 105 being prevented by the valve member 116, again, being forced-open to vent the excess fuel pressure from the supply side thereof to the drain passage 121.

As can be appreciated from the drawings, the valve 115 requires only a single part in comparison to the three required by valve assembly 15. Furthermore, because valve member 116 can be accommodated in the provided drain annulus 121*a*, a short and direct straight connection can be provided from the second supply path 108 to the drain passage 121. This offers substantial advantages in that the lower barrel member 17 no longer has to be precision machine to accommodate the valve assembly 15 and the passages to and from it (as in the prior art of FIGS. 1–3), thereby saving costs and enabling this part to be merged into the spring housing member 102*c* (as shown in FIG. 4) or either reduced in size or eliminated if a shorter injector is desired. Moreover, because relief port 115*b* provides a short and direct straight connection from the second supply path 108 to the drain passage 121, the time that it takes the pressure wave to reach the valve member 116 is reduced and inconsistent variations in the pressure of the fuel as it travels to the valve member 116 can be significantly reduced, thereby achieving greater shot-to-shot consistency over a wide range of shot volumes (e.g., 6 ml to 18 ml), even under engine idling conditions.

While only one embodiment in accordance with the present invention has been shown and described, it should be understood that the invention is not limited thereto, and is susceptible to numerous changes and modifications as will have become apparent to those skilled in the art based on this disclosure. Therefore, this invention is not limited to the details shown and described herein, and includes all such changes and modifications as are encompassed by the scope of the appended claims.

Industrial Applicability

The present invention will find applicability to solenoid operated unit fuel injectors of various types and for various internal combustion engine applications where a plurality of such injectors share a fuel supply in a manner which can enable supply-side pressure increases at one injector to affect the injection accuracy of another injector.

What is claimed is:

1. A solenoid operated unit fuel injector for internal combustion engines of the type capable of having distinct timing, metering and injection periods and which comprises an injector body having an axial bore in respective portions of which a variable volume timing chamber and a variable volume metering chamber are formed, a fuel supply circuit being provided in said injector body, said fuel supply circuit having a first portion defining a path which leads to said metering chamber and a second portion which defines a path which leads to said timing chamber, a solenoid valve in said second portion of the fuel supply circuit for blocking and unblocking flow along said second portion of the fuel supply circuit to and from said timing chamber, and a drain path formed in said injector body along which fuel in the timing chamber is drained from a timing chamber spill port to a drain port for draining the fuel out of the injector body, and pressure responsive means for venting fuel from said fuel supply circuit into said fuel drain path when the pressure of fuel in said fuel supply circuit exceeds a predetermined value; wherein said pressure responsive means comprises a radial bore in the injector barrel which leads directly from the second portion of the fuel supply circuit to the fuel drain path and a C-shaped spring valve mounted on the injector barrel for controlling venting of fuel through the radial bore.

2. A solenoid operated unit fuel injector according to clam 1, wherein said radial bore is at a location above that of the timing chamber spill port and that of a metering spill port by which fuel is drained from said metering chamber into said fuel supply circuit after completion of an injection cycle.

3. A solenoid operated unit fuel injector according to claim 1, wherein said injector body comprises an upper barrel, a spacer member, a spring housing, an injector nozzle, and an injector retainer which receives the spacer member nozzle valve spring housing and injector nozzle, stacked one upon the other, and secures them to the upper barrel.

4. A solenoid operated unit fuel injector according to claim 3, wherein said spacer member is formed of one piece with said nozzle spring housing.

5. A solenoid operated unit fuel injector according to claim 3, wherein the injector body also has an axial bore, a timing plunger and a metering plunger mounted for reciprocation in said axial bore; wherein the variable volume timing chamber is defined in said axial bore between the timing plunger and the metering plunger; and wherein the variable volume metering chamber is formed by an end portion of said axial bore located between the metering plunger and the inner barrel.

6. A solenoid operated unit fuel injector according to claim 5, wherein the supply circuit provided in the injector body comprises a fuel annulus formed between the injector retainer, and the spacer member and spring housing; wherein said first portion leads from the fuel annulus to the metering chamber and the second portion leads from the fuel annulus to the timing chamber.

7. A solenoid operated unit fuel injector according to claim 6, wherein said spacer member is formed of one piece with said nozzle spring housing.

8. A solenoid operated unit fuel injector according to claim 3, wherein the supply circuit, provided in the injector body, comprises a fuel annulus formed between the injector retainer; and the spacer member and spring housing; wherein said first portion leads from the fuel annulus to the metering chamber and the second portion leads from the fuel annulus to the timing chamber.

9. A solenoid operated unit fuel injector according to claim 8, wherein said spacer member is formed of one piece with said nozzle spring housing.

10. A solenoid operated unit fuel injector according to claim 8, wherein said drain path comprises a drain passage which includes a drain annulus between the inner barrel and the injector retainer; and wherein said C-shaped spring valve member is mounted on the spacer member within said drain annulus.

11. A solenoid operated unit fuel injector according to claim 10, wherein said radial bore is at a location above that of the timing chamber spill port and that of a metering spill port by which fuel is drained from said metering chamber into said fuel supply circuit after completion of an injection cycle.

12. A solenoid operated unit fuel injector according to claim 11, wherein said spacer member is formed of one piece with said nozzle spring housing.

13. A solenoid operated unit fuel injector according to claim 3, wherein said drain path comprises a drain passage which includes a drain annulus between the spacer member and the injector retainer; and wherein said C-shaped spring valve member is mounted on the spacer member within said drain annulus.

14. A solenoid operated unit fuel injector according to claim 13, wherein said radial bore is at a location above that of the timing chamber spill port and that of a metering spill port by which fuel is drained from said metering chamber into said fuel supply circuit after completion of an injection cycle.

15. A solenoid operated unit fuel injector according to claim 14, wherein said spacer member is formed of one piece with said nozzle spring housing.

* * * * *